US011511208B1

(12) United States Patent
Zhang

(10) Patent No.: US 11,511,208 B1
(45) Date of Patent: Nov. 29, 2022

(54) BIONIC STRESS RELIEF TOY

(71) Applicant: Shenzhen Xinaosheng Outdoor Products Co., Ltd., Guangdong (CN)

(72) Inventor: Penghe Zhang, Guangdong (CN)

( * ) Notice: Subject to any disclaimer, the term of this patent is extended or adjusted under 35 U.S.C. 154(b) by 0 days.

(21) Appl. No.: 17/841,626

(22) Filed: Jun. 15, 2022

(30) Foreign Application Priority Data

Oct. 13, 2021 (CN) ..... 202122459029.4
Feb. 9, 2022 (CN) ..... 202220265718.3

(51) Int. Cl.
*A63H 3/48* (2006.01)

(52) U.S. Cl.
CPC ..... *A63H 3/48* (2013.01)

(58) Field of Classification Search
CPC ... A63H 3/20; A63H 3/46; A63H 3/48; A63H 33/06; A63H 33/062; A63H 33/065
USPC ..... 446/101, 102, 104, 117, 120, 121, 124, 446/376, 383
See application file for complete search history.

(56) References Cited

U.S. PATENT DOCUMENTS 862,206 A * 8/1907 Sillman ..... A63H 3/04 446/376
3,192,738 A * 7/1965 Charles et al. ..... A44C 11/002 63/39
4,044,725 A * 8/1977 Miller ..... A01K 27/001 59/84
D254,798 S * 4/1980 Johnstone ..... D21/585
4,200,995 A * 5/1980 Trella ..... G09B 23/34 434/274
5,135,233 A * 8/1992 Leas ..... A63B 67/10 446/121
5,486,127 A * 1/1996 Wolfe ..... G09B 23/34 24/700
5,531,625 A * 7/1996 Zhong ..... A63H 3/46 59/80
5,620,352 A * 4/1997 Tzong ..... A63H 3/04 446/120
5,752,869 A * 5/1998 Huff ..... A63H 3/16 446/104
6,074,270 A * 6/2000 Wilcox ..... A63H 3/46 446/370
6,083,077 A * 7/2000 McGinn ..... A63H 3/16 446/101
6,109,999 A * 8/2000 Kuo ..... A63B 19/00 446/236
6,161,975 A * 12/2000 Clarke ..... B43K 29/00 446/101
6,253,712 B1 * 7/2001 Johnson ..... F16L 11/18 285/261

(Continued)

*Primary Examiner* — Joseph B Baldori

(57) ABSTRACT

A bionic stress relief toy, including a plurality of splicing bodies connected in sequence. The splicing body includes a funnel-shaped main shell, wherein a peripheral edge surrounding the main shell obliquely extends from a front side edge of the main shell rearward and outward, a center in the main shell is concavely provided with a female connector, and a rear end of the main shell is provided with a male connector corresponding to the female connector. During assembly, the male connector of one splicing body is rotatably connected to the female connector of the next splicing body, and a rear section of the peripheral edge of one splicing body is located outside a front section of the peripheral edge of the next splicing body.

23 Claims, 7 Drawing Sheets

(56) References Cited

U.S. PATENT DOCUMENTS

| | | | | |
|---|---|---|---|---|
| 6,264,522 | B1 * | 7/2001 | Dickson | A44C 13/00 446/124 |
| 6,478,653 | B1 * | 11/2002 | Langton | A63H 3/46 446/373 |
| 6,854,768 | B2 * | 2/2005 | Elder | B29C 45/0003 285/285.1 |
| 7,354,330 | B2 * | 4/2008 | Bentley, Jr. | A44C 13/00 446/124 |
| 7,798,884 | B2 * | 9/2010 | Barcelo | A63H 33/101 446/124 |
| 8,607,541 | B1 * | 12/2013 | Cavuoti | F16G 13/18 446/236 |
| 11,224,966 | B2 * | 1/2022 | Kuter-Arnebeck | B25J 15/0608 |
| 2015/0231488 | A1 * | 8/2015 | Hedeen, Jr. | A63H 33/06 273/276 |
| 2016/0113243 | A1 * | 4/2016 | Mullin | A01K 5/00 119/709 |

* cited by examiner

BIONIC STRESS RELIEF TOY

CROSS-REFERENCE TO RELATED APPLICATION

This application claims the priority and benefit of the patent application No. CN202122459029.4 filed with China National Intellectual Property Administration on Oct. 13, 2021, the patent application No. CN202220265718.3 filed with China National Intellectual Property Administration on Feb. 9, 2022, and entitled "BIONIC STRESS RELIEF TOY", which is hereby incorporated by reference herein in its entirety.

TECHNICAL FIELD

The present invention relates to the technical field of toys, in particular to a bionic stress relief toy.

BACKGROUND

To help children grow up healthy and happy, various toys are available in the market to entertain children and keep them from getting bored, including toy cars, toy guns and bionic toys such as bionic pandas, bionic birds and bionic cartoon characters. In spite of the rich variety of children's toys, the curious nature of children makes them lose interest in new toys quickly, and the toys no longer hold appeal to them. Therefore, novel toys must be constantly developed and introduced to the market to meet the demands.

SUMMARY

In view of the deficiencies in the related art, an objective of the present invention is to provide a bionic stress relief toy which has the advantages of being novel and fun, and capable of relieving boredom and stress.

To achieve the above objective, the present invention adopts the following technical scheme.

A bionic stress relief toy comprises a plurality of splicing bodies connected in sequence. The splicing body comprises a funnel-shaped main shell, wherein an inner cavity with an inner diameter gradually decreasing in a front-rear direction is formed in a front side of the main shell, a peripheral edge surrounding the main shell obliquely extends from a front side edge of the main shell rearward and outward, a center of the inner cavity of the main shell is concavely provided with a female connector, and a rear end of the main shell is provided with a male connector corresponding to the female connector; and during assembly, the male connector of one splicing body is rotatably connected to the female connector of the next splicing body, and a rear section of the peripheral edge of one splicing body is located outside a front section of the peripheral edge of the next splicing body.

Optionally, an outer side face of the peripheral edge is a convex cambered surface, and an inner side face of the peripheral edge is a concave cambered surface.

Optionally, a joint between the main shell and the peripheral edge is rounded.

Optionally, the rear end of the main shell is provided with an extension protruding rearward, and the male connector is connected to a rear end of the extension.

Optionally, the bionic stress relief toy further comprises a toy head and a toy tail, wherein a rear end of the toy head is provided with a male connector corresponding to the female connector, and a front end of the toy tail is provided with a female connector corresponding to the male connector; and during assembly, the male connector of the toy head is rotatably connected to the female connector of the first splicing body, and the male connector of the last splicing body is rotatably connected to the female connector of the toy tail.

Optionally, the female connector is a circular mating dimple, and the male connector is a spherical protrusion.

Optionally, the male connector of one splicing body is connected to the female connector of the next splicing body in a forward or rearward rotation manner; and when one splicing body rotates to an extreme position in the forward or rearward direction relative to the former splicing body, an inner wall of the rear section of the peripheral edge of the former splicing body and an outer wall of the front section of the peripheral edge of the splicing body are at least spaced apart from each other on a radial outer side, and an outside of the front side edge of the main shell of the splicing body is spaced from a rear wall of the main shell of the former splicing body.

Optionally, the splicing body is made of a hard material.

Optionally, when one splicing body rotates to an extreme position in the forward or rearward direction relative to the former splicing body, the peripheral edge of the former splicing body covers the front side edge of the main shell of the splicing body on a radial outer side.

Optionally, when one splicing body rotates to an extreme position in the forward or rearward direction relative to the former splicing body, the peripheral edge of the splicing body is hidden in the peripheral edge of the former splicing body on a radial inner side, or the peripheral edge of the splicing body protrudes from the peripheral edge of the former splicing body on the radial inner side by a length less than or equal to 1.5 times the thickness of the peripheral edge.

Optionally, the outer diameters of the peripheral edges of the plurality of splicing bodies gradually increase and then gradually decrease in the front-rear direction.

Optionally, the female connector is formed at the rear of the inner cavity of the main shell, and a depth of the inner cavity of the middle splicing body is larger than that of the inner cavity of the last splicing body and less than that of the inner cavity of the first splicing body.

Optionally, the toy head comprises a body part and a suspension part connected to a front end of the body part, and a rear end of the body part is connected to the male connector; and the suspension part comprises at least two upper suspension arms and at least two lower suspension arms, and the upper suspension arms and the lower suspension arms are inclined outward and forward from a center of the body part.

Optionally, the toy head comprises an enclosing part and a connecting part connected to a rear end of the enclosing part, a rear end of the connecting part is connected to the male connector, and the connecting part and the enclosing part are spaced apart to form a receiving space for receiving the front section of the peripheral edge of the first splicing body, and the toy tail comprises a tail cone segment and a transition cone segment which are connected to each other, a rear section of the peripheral edge of the last splicing body is located outside the transition cone segment, the female connector is connected to the inside of the tail cone segment, an outer diameter of the transition cone segment gradually increases in the front-rear direction, and an outer diameter of the tail cone segment gradually decreases in the front-rear direction.

Due to the adoption of the above scheme, compared with the related art, the present invention has the following beneficial effects. By designing the plurality of splicing bodies which are connected in sequence, and making the male connector of one splicing body rotatably connected to the female connector of the next splicing body and the rear section of the peripheral edge of one splicing body located outside the front section of the peripheral edge of the next splicing body, a twistable toy is formed and has the advantages of being novel and fun, and capable of relieving boredom and stress.

LIST OF REFERENCE NUMERALS

Figure 1:
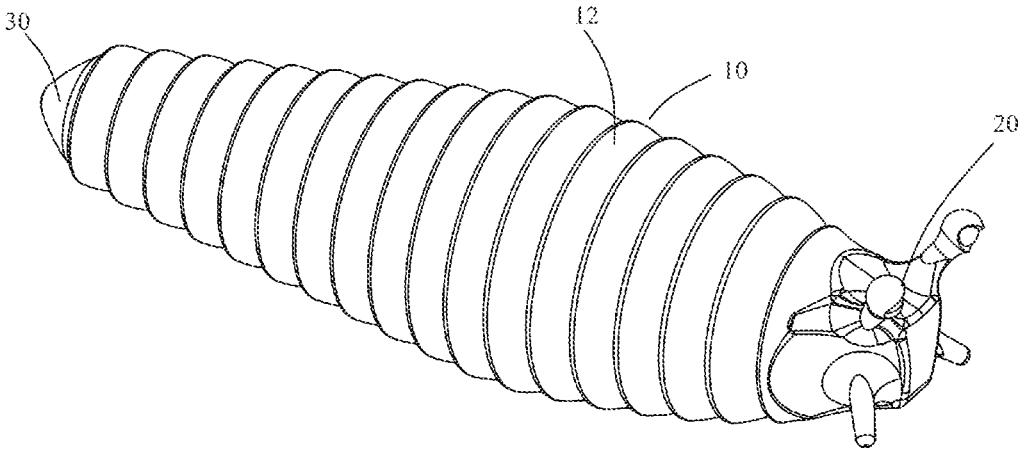
FIG. 1 is a schematic diagram of an embodiment of the present invention.
Figure 2:
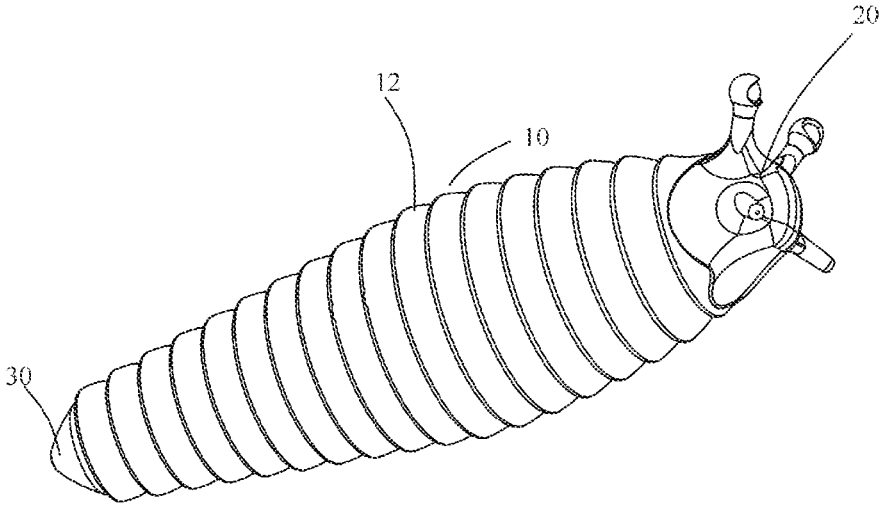
FIG. 2 is another schematic diagram of an embodiment of the present invention.

10. splicing body, 11. main shell; 12. peripheral edge; 13. female connector, 14. male connector, 15. extension; 20. toy head; 30. toy tail; 111. inner cavity; 21. body part; 22. suspension part; 221. upper suspension arm; 222. lower suspension arm; 211. enclosing part; 212. connecting part; 31. tail cone segment; and 32. transition cone segment.

DETAILED DESCRIPTION

The embodiments of the present invention will be described in detail with reference to the drawings below, but the present invention can be implemented in many different ways defined and covered by the claims.

As shown in FIGS. 1-7, a bionic stress relief toy provided by this embodiment comprises a plurality of splicing bodies 10 connected in sequence. The splicing body 10 comprises a funnel-shaped main shell 11, wherein an inner cavity 111 with an inner diameter gradually decreasing in a front-rear direction is formed in a front side 101 of the main shell 11, a peripheral edge 12 surrounding the main shell 11 obliquely extends from a front side edge 103 of the main shell 11 rearward and outward, and an outer side face 121 of the peripheral edge 12 is curved; moreover, a joint between the main shell 11 and the peripheral edge 12 is rounded, a center of the inner cavity 111 of the main shell 11 is concavely provided with a female connector 13, a rear end of the main shell 11 is provided with a male connector 14 corresponding to the female connector 13, the female connector 13 is a circular mating dimple, and the male connector 14 is a spherical protrusion. During assembly, the male connector 14 of one splicing body 10 is rotatably connected to the female connector 13 of the next splicing body 10. A rear section of the peripheral edge 12 of one splicing body 10 is located outside a front section of the peripheral edge 12 of the next splicing body 10, so that the plurality of splicing bodies 10 can form a twistable toy.

In this embodiment, the rear end of the main shell 11 is provided with an extension 15 protruding rearward, and the male connector 14 is connected to a rear end of the extension 15. By providing the extension 15, a certain distance can be ensured between a rear wall 102 of the main shell 11 of one splicing body 10 and a front wall of the main shell 11 of the next splicing body 10, so that one splicing body 10 can rotate more smoothly relative to the next splicing body 10.

A toy head 20 and a toy tail 30 are also provided. A rear end of the toy head 20 is provided with a male connector 14 corresponding to the female connector 13, and a front end of the toy tail 30 is provided with a female connector 13 corresponding to the male connector 14. During assembly, the male connector 14 of the toy head 20 is rotatably connected to the female connector 13 of the first splicing body 10, and the male connector 14 of the last splicing body 10 is rotatably connected to the female connector 13 of the toy tail 30. The toy head 20 and the toy tail 30 can be made to look like corresponding parts of animals. In this embodiment, the toy head 20 and the toy tail 30 are the head and tail of a caterpillar respectively.

In an embodiment, referring to FIGS. 1-7, an outer side face 121 of the peripheral edge 12 is a convex cambered surface, and an inner side face 122 of the peripheral edge 12 is a concave cambered surface. By making the outer side face 121 of the peripheral edge 12 a convex cambered surface and the inner side face 122 of the peripheral edge 12 a concave cambered surface, the peripheral edge 12 as a whole forms a curved plate protruding from inside to outside. In this way, the peripheral edges 12 of the plurality of splicing bodies 10 are partially overlaid with each other in the front-rear direction in sequence, and when the toy is in a straight state (refer to FIGS. 1-3), the peripheral edge 12 of one splicing body 10 can block a gap between a front side edge 103 of the main shell 11 of the splicing body 10 and a front side edge 103 of the main shell 11 of the next splicing body 10. Compared with a situation that the outer side face 121 of the peripheral edge 12 is a concave cambered surface, in this case, a gap opening between the peripheral edges 12 of two adjacent splicing bodies 10 faces rearward instead of upward, which can prevent foreign matter from being stuck between two adjacent peripheral edges 12, make the toy more comfortable to hold, effectively protect hands from getting hurt, and make the relative rotation between two adjacent splicing bodies 10 smoother.

Figure 6:
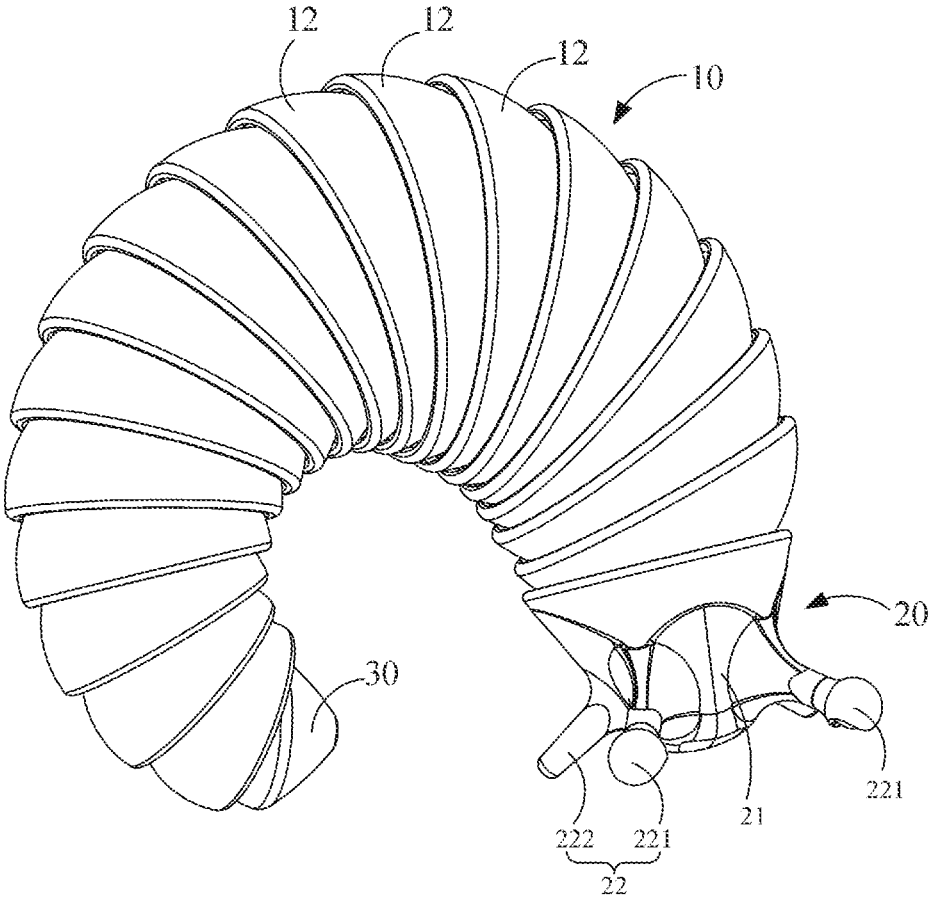
FIG. 6 is a schematic diagram of a bionic stress relief toy according to another embodiment of the present invention.
Figure 7:
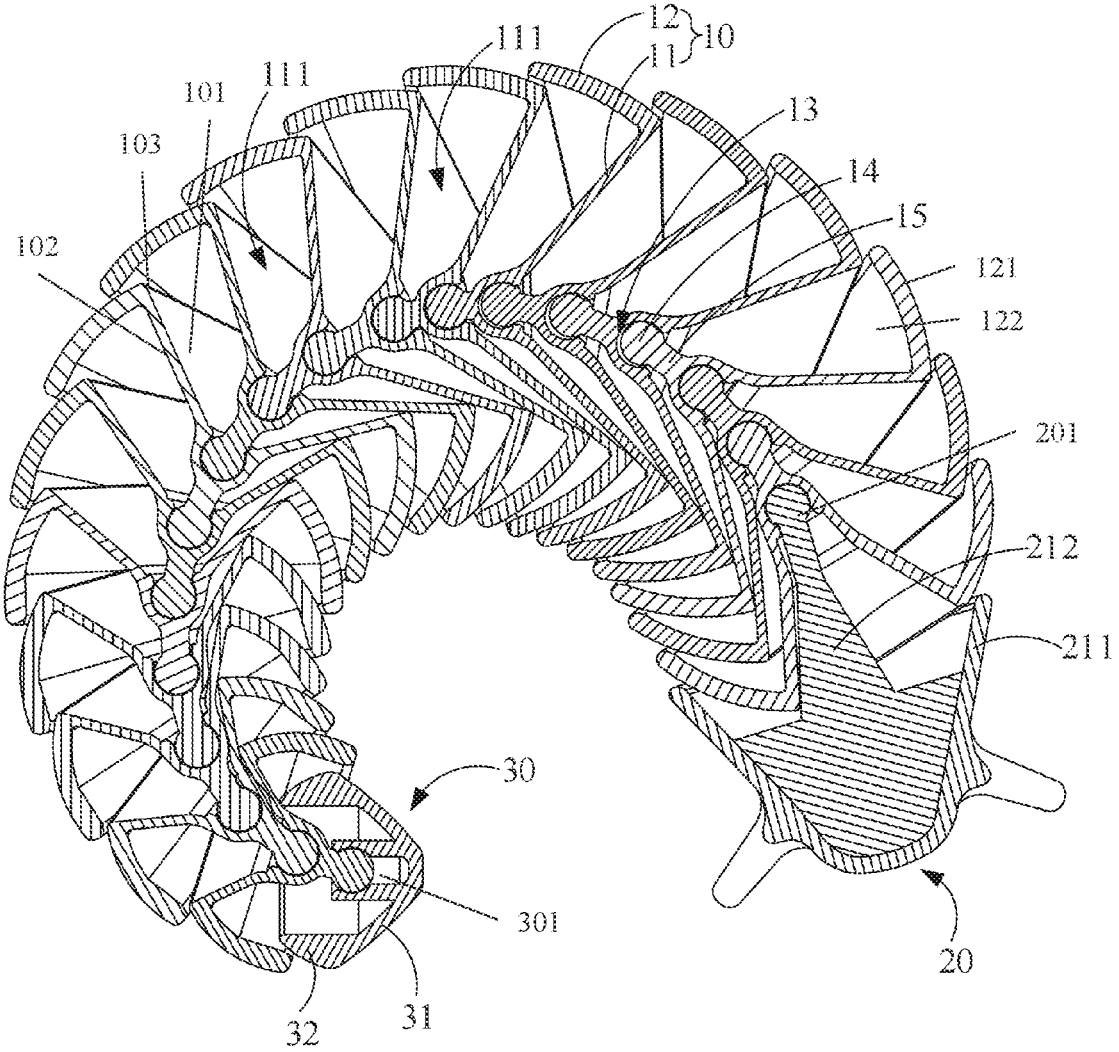
FIG. 7 is a sectional view of a bionic stress relief toy in FIG. 6 from a certain angle.

Further, as shown in FIGS. 6 and 7, the male connector 14 of one splicing body 10 is connected to the female connector 13 of the next splicing body 10 in a forward or rearward rotation manner. When one splicing body 10 rotates to an extreme position in the forward or rearward direction relative to the former splicing body 10, the inner wall of the rear section of the peripheral edge 12 of the former splicing body 10 and the outer wall of the front section of the peripheral edge 12 of the splicing body 10 are spaced apart from each other at least on a radial outer side, and an outside of the front side edge 103 of the main shell 11 of the splicing body 10 is spaced from the rear wall 102 of the main shell 11 of the former splicing body 10.

In this embodiment, when the female connector 13 is a circular mating dimple and the male connector 14 is a spherical protrusion, one splicing body 10 can rotate around a circumferential direction of the main shell 11 relative to the next splicing body 10, and one splicing body 10 can rotate back and forth relative to the next splicing body 10. Therefore, the toy can deform more flexibly, making it more fun to play with.

It should be noted that when one splicing body 10 rotates to an extreme position in the forward or rearward direction relative to the former splicing body 10, the whole toy is in a curled state. In this case, a radial inner side of the splicing body 10 refers to a side close to a center of a circle enclosed by the toy, and the radial outer side of the splicing body 10 refers to a side away from the center of the circle enclosed by the toy. It is possible to make the inner wall of the rear section of the peripheral edge 12 of one splicing body 10 abut against the outer wall of the front section of the peripheral edge 12 of the next splicing body 10 on the radial inner side of the splicing body 10, or make the inner side of the front side edge 103 of the main shell 11 of one splicing body 10 abut against the rear wall 102 of the main shell 11 of the former splicing body 10, or make the rear wall 102 of the main shell 11 of one splicing body 10 abut against the front wall of the main shell 11 of the next splicing body 10, so that one splicing body 10 can rotate to an extreme position in the forward or rearward direction relative to the former splicing body 10.

It can be understood that, to make the male connector 14 of one splicing body 10 connected to the female connector 13 of the next splicing body 10 in a forward and rearward rotation manner, the rear wall 102 of the main shell 11 of the splicing body 10 and the front wall of the main shell 11 of the next splicing body 10 should be spaced apart when the toy is in a straight state. Because the front side 101 of the main shell 11 is provided with the inner cavity 111 with the inner diameter gradually decreasing rearward, the outer side face 121 of the peripheral edge 12 is a convex cambered surface, and the inner side face 122 of the peripheral edge 12 is a concave cambered surface, one splicing body 10 can rotate in the forward or rearward direction relative to the next splicing body 10.

When one splicing body 10 rotates to an extreme position in the forward or rearward direction relative to the former splicing body 10, the inner wall of the rear section of the peripheral edge 12 of the former splicing body 10 and the outer wall of the front section of the peripheral edge 12 of the splicing body 10 are spaced apart from each other at least on the radial outer side, and the outside of the front side edge 103 of the main shell 11 of the splicing body 10 is spaced from the rear wall 102 of the main shell 11 of the former splicing body 10. In this way, the whole toy can twist more flexibly and smoothly in the forward or rearward direction, and the swing of one splicing body 10 can drive the next splicing body 10 to swing with a greater amplitude, so as to imitate the crawling of a caterpillar. The toy can be transformed in many ways, making it more fun to play with.

Further, the splicing body 10 is made of a hard material. Specifically, the splicing body 10 can be made of hard materials such as hard plastic and wood.

When one splicing body 10 rotates to an extreme position in the forward or rearward direction relative to the former splicing body 10, the inner wall of the rear section of the peripheral edge 12 of the former splicing body 10 and the outer wall of the front section of the peripheral edge 12 of the splicing body 10 are spaced apart from each other at least on the radial outer side, and the outside of the front side edge 103 of the main shell 11 of the splicing body 10 is spaced from the rear wall 102 of the main shell 11 of the former splicing body 10. In this case, a cavity between the outside of the front side edge 103 of the main shell 11 of the splicing body 10 and the rear wall 102 of the main shell 11 of the former splicing body 10 is made to communicate with the outside air through a gap between outer sides of the two adjacent peripheral edges 12. Since the splicing body 10 is made of a hard material and the front side 101 of the main shell 11 has a cavity, when one splicing body 10 rotates to an extreme position in the forward or rearward direction relative to the former splicing body 10, the front side edge 103 of the main shell 11 of the splicing body 10 will hit the rear wall 102 of the former main shell 11 or the rear wall 102 of the main shell 11 of the former splicing body 10 will hit the front wall of the main shell 11 of the splicing body 10, so that the toy can give out crisp knocking sound, making the toy more enjoyable and greatly improving the stress relief effect.

In an embodiment, referring to FIGS. 6 and 7, the male connector 14 of one splicing body 10 is connected to the female connector 13 of the next splicing body 10 in a forward or rearward rotation manner. When one splicing body 10 rotates to an extreme position in the forward or rearward direction relative to the former splicing body 10, the peripheral edge 12 of the former splicing body 10 covers the front side edge 103 of the main shell 11 of the splicing body 10 on the radial outer side.

In this embodiment, It should be noted that when one splicing body 10 rotates to an extreme position in the forward or rearward direction relative to the former splicing body 10, the whole toy is in a curled state. In this case, a radial inner side of the splicing body 10 refers to a side close to a center of a circle enclosed by the toy, and the radial outer side of the splicing body 10 refers to a side away from the center of the circle enclosed by the toy. When one splicing body 10 rotates to an extreme position in the forward or rearward direction relative to the former splicing body 10, the peripheral edge 12 of the former splicing body 10 covers the front side edge 103 of the main shell 11 of the splicing body 10 on the radial outer side, so that even if the whole toy twists and curls to an extreme position, the peripheral edge 12 of the former splicing body 10 can still cover the front side edge 103 of the main shell 11 of the splicing body 10, thus effectively preventing dust and other foreign matter from entering the splicing bodies 10 and protecting children from hand injuries during playing.

Further, referring to FIGS. 6 and 7 again, when one splicing body 10 rotates to an extreme position in the forward or rearward direction relative to the former splicing body 10, the peripheral edge 12 of the splicing body 10 is hidden in the peripheral edge 12 of the former splicing body 10 on the radial inner side, or the peripheral edge 12 of the splicing body 10 protrudes from the peripheral edge 12 of the former splicing body 10 on the radial inner side, and the peripheral edge 12 of the splicing body 10 protrudes from the peripheral edge 12 of the former splicing body 10 on the radial inner side by a length less than or equal to 1.5 times the thickness of the peripheral edge 12.

In this embodiment, when one splicing body 10 rotates to an extreme position in the forward or rearward direction relative to the former splicing body 10, the peripheral edge 12 of the splicing body 10 is hidden in the peripheral edge 12 of the former splicing body 10 on the radial inner side, and when the toy is fully curled, the diameter of an inner circle enclosed by the plurality of splicing bodies 10 is smaller, so that the curled deformation degree of the toy is larger and the volume after curling is smaller.

By making the peripheral edge 12 of the splicing body 10 protrude from the peripheral edge 12 of the former splicing body 10 on the radial inner side, the peripheral edge 12 of the splicing body 10 can be prevented from being stuck on an inner side of the former splicing body 10 on the radial inner side when the toy is curled, so that the twisting flexibility and transformation smoothness of the toy can be improved, and the service performance and quality of the product can be guaranteed.

Specifically, the ratio of the length by which the peripheral edge 12 of the splicing body 10 protrudes from the peripheral edge 12 of the former splicing body 10 on the radial inner side to the thickness of the peripheral edge 12 may be 0.5, 0.7, 1, 1.1, 1.3, 1.5, etc. By making the length by which the peripheral edge 12 of the splicing body 10 protrudes from the peripheral edge 12 of the former splicing body 10 on the radial inner side less than or equal to 1.5 times the thickness of the peripheral edge 12, the peripheral edge 12 of the splicing body 10 will not protrude from the peripheral edge 12 of the former splicing body 10 on the radial inner side too far, so that when the toy is fully curled, the diameter of an inner circle enclosed by the plurality of splicing bodies 10 is smaller, the curled deformation degree of the toy is larger and the volume after curling is smaller.

In an embodiment, as shown in FIGS. 1-3, FIG. 6 and FIG. 7, the outer diameters of the peripheral edges 12 of the plurality of splicing bodies 10 gradually increase and then gradually decrease in the front-rear direction. In this way, the first splicing body 10 and the last splicing body 10 can be curled toward the middle at the same time, so that the plurality of splicing bodies 10 can be curled into a ring. On the one hand, the toy can be transformed in more manners, making it more fun to play with, and on the other hand, the toy can be packaged, transported or stored in a curled state, so that the length of packaging and storage can be reduced, allowing users to choose packaging and storage states more flexibly.

Figure 3:
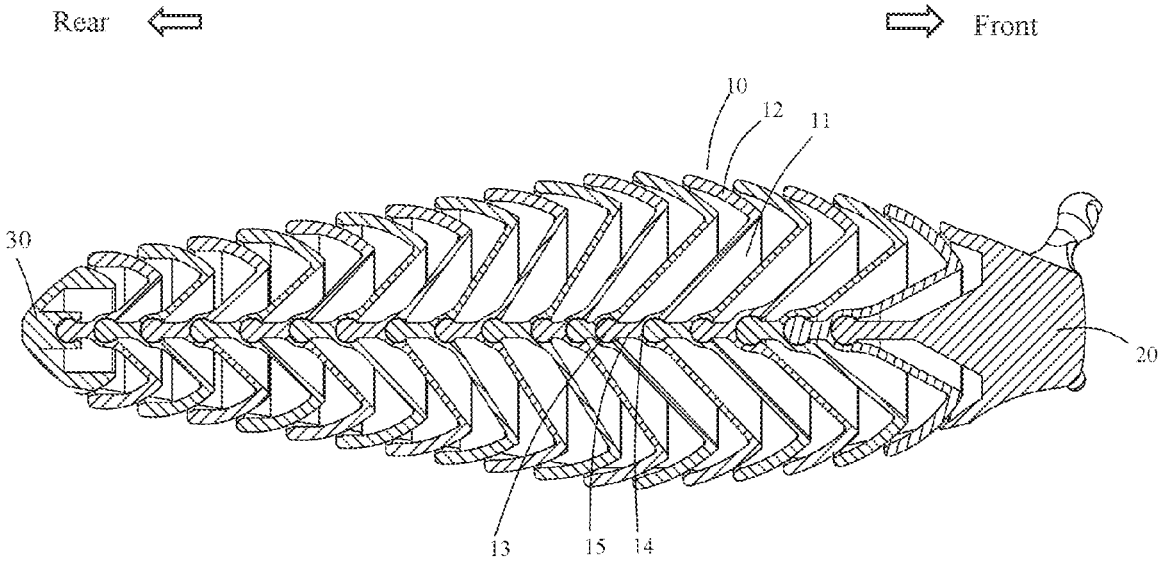
FIG. 3 is a cross-sectional view of an embodiment of the present invention.
Figure 4:
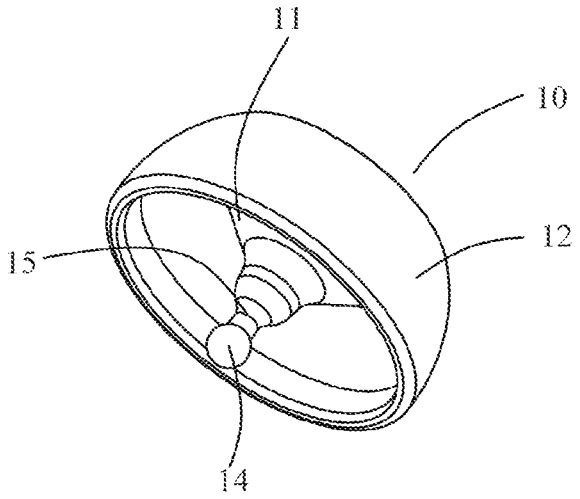
FIG. 4 is a schematic diagram of a splicing body according to an embodiment of the present invention.
Figure 5:
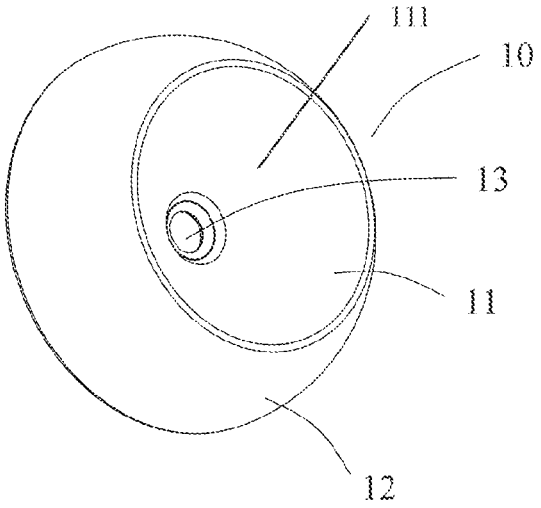
FIG. 5 is another schematic diagram of a splicing body according to an embodiment of the present invention.

In an embodiment, referring to FIGS. 3 and 7, the female connector 13 is formed at the rear of the inner cavity 111 of the main shell 11, and the depth of the inner cavity 111 of the middle splicing body 10 is larger than that of the inner cavity 111 of the last splicing body 10 and less than that of the inner cavity 111 of the first splicing body 10.

In this embodiment, it can be understood that the first splicing body 10 is a splicing body 10 located at a head end of the toy, and in an embodiment with a toy head 20, the first splicing body 10 is a splicing body 10 connected to the toy head 20. The last splicing body 10 is a splicing body 10 located at a tail end of the toy, and in an embodiment with a toy tail 30, the last splicing body 10 is a splicing body 10 connected to the toy tail 30. The middle splicing bodies 10 are splicing bodies 10 located between the first splicing body 10 and the last splicing body 10.

When the toy is played with, generally, the first splicing body 10 drives the middle splicing bodies 10 to swing, so as to drive the last splicing body 10 to swing. By making the depth of the inner cavity 111 of the middle splicing body 10 larger than that of the inner cavity 111 of the last splicing body 10 and smaller than that of the inner cavity 111 of the first splicing body 10, the amplitude of the front-back swing between the first splicing body 10 and the splicing body 10 connected to the first splicing body 10 is the largest, and the amplitude of the front-back swing between the last splicing body 10 and the splicing body 10 connected to the last splicing body 10 is the smallest, which allows the toy to be transformed in more ways. In combination with the above embodiment with the extension 15, a distance between the main shells 11 of two adjacent splicing bodies 10 can also be controlled by designing a length of the extension 15.

In combination with the above embodiment with the toy head 20 and the toy tail 30, further, the toy head 20 comprises a body part 21 and a suspension part 22 connected to a front end of the body part 21, and a rear end of the body part 21 is connected to the head male connector 201. The suspension part 22 comprises at least two upper suspension arms 221 and at least two lower suspension arms 222, and the upper suspension arms 221 and the lower suspension arms 222 are inclined outward and forward from a center of the body part 21.

In this embodiment, the body part 21 may specifically be of a solid structure, which can serve as a balance weight of the toy head 20. Of course, the body part 21 may be a thin-walled shell. By making the suspension part 22 comprise at least two upper suspension arms 221 and at least two lower suspension arms 222, the toy can be hung through the suspension part 22, thus giving users more storage options. By making the upper suspension arms 221 and the lower suspension arms 222 inclined outward and forward from the center of the body part 21, the plurality of upper suspension arms 221 and the plurality of lower suspension arms 222 can form supporting legs to support the toy, so that the toy can be transformed in more ways and is more fun to play with. Specifically, two upper suspension parts 22 and two lower suspension parts 22 can be arranged, and the two upper suspension parts 22 and the two lower suspension parts 22 are made to look like tentacles of a slug, so that the toy can have a complete form. Optionally, a length of the lower suspension arm 222 is smaller than that of the upper suspension arm 221.

Further, the toy head 20 comprises an enclosing part 211 and a connecting part 212 connected to a rear end of the enclosing part 211. A rear end of the connecting part 212 is connected to the head male connector 201, and the connecting part 212 and the enclosing part 211 are spaced apart to form a receiving space for receiving the front section of the peripheral edge 12 of the first splicing body 10.

The toy tail 30 comprises a tail cone segment 31 and a transition cone segment 32 which are connected to each other. A rear section of the peripheral edge 12 of the last splicing body 10 is located outside the transition cone segment 32, and the tail female connector 301 is connected to the inside of the tail cone segment 31. An outer diameter of the transition cone segment 32 gradually increases in the front-rear direction, and an outer diameter of the tail cone segment 31 gradually decreases in the front-rear direction.

In this embodiment, the connecting part 212 may specifically be of a cone-shaped structure that tapers rearward. In this way, the connecting part 212 and the enclosing part 211 are spaced apart to form the receiving space for receiving the front section of the peripheral edge 12 of the first splicing body 10, so that dust and other foreign matter can be prevented from entering the toy head 20, and the toy can have a complete form. The toy tail 30 comprises the tail cone segment 31 and the transition cone segment 32 which are connected to each other. The outer diameter of the transition cone segment 32 gradually increases in the front-rear direction, so that it is ensured that the transition cone segment 32 can be surrounded by the peripheral edge 12 of the last splicing body 10 during rotation.

The outer diameter of the tail cone segment 31 gradually decreases in the front-rear direction, so that the forward and rearward rotation between the toy tail 30 and the last splicing body 10 is smoother. The outer diameter of the tail cone segment 31 gradually decreases in the front-rear direction, which ensures that the toy can have a complete form without affecting the rotation between the toy tail 30 and the last splicing body 10.

The above are only some preferable embodiments of the present invention, and is not therefore limiting the scope of protection of the present invention. Any equivalent structural or equivalent process variations made by using the contents of the specification and the drawings of the present invention, or directly or indirectly applied to other related technical fields, are likewise included in the scope of protection of the present invention.

The invention claimed is:

1. A bionic stress relief toy, comprising a plurality of splicing bodies connected in sequence, each splicing body comprising a main shell in a funnel shape, wherein an inner cavity with an inner diameter gradually decreasing in a front-rear direction is formed in a front side of the main shell, a peripheral edge surrounding the main shell obliquely extends from a front side edge of the main shell rearward and outward, a female connector is formed at a center of the main shell, and a male connector rearward from an end of the female connector; the male connector of one splicing body is rotatably connected to the female connector of a next splicing body, and a rear section of the peripheral edge of one splicing body is located outside a front section of the peripheral edge of the next splicing body;

the peripheral edge is integrally formed with the main shell; each splicing body has a substantially W-shaped cross section.

2. The bionic stress relief toy of claim 1, wherein an outer side face of the peripheral edge is a convex cambered surface, and an inner side face of the peripheral edge is a concave cambered surface.

3. The bionic stress relief toy of claim 2, wherein the male connector of the one splicing body is connected to the female connector of the next splicing body in a forward or rearward rotation manner; and when the next splicing body rotates to an extreme position in a forward or rearward direction relative to the one splicing body, the inner side face of the peripheral edge of the one splicing body and the outer side face of the peripheral edge of the next splicing body are at least spaced apart from each other on a radial outer side of the stress relief toy, and the front side edge of the main shell of the next splicing body is spaced from a rear wall of the main shell of the one splicing body on the radial outer side of the stress relief toy; wherein when the rear wall of the main shell of the one splicing body on a radial inner side of the stress relief toy abuts against the front side edge of the main shell of the next splicing body, the next splicing body reaches the extreme position.

4. The bionic stress relief toy of claim 3, wherein each splicing body is made of a hard material.

5. The bionic stress relief toy of claim 4, wherein the plurality of splicing bodies further include a first splicing body, a last splicing body, and at least one middle splicing body, wherein a depth of the inner cavity of the at least one middle splicing body is larger than a depth of the inner cavity of the last splicing body and less than a depth of the inner cavity of the first splicing body.

6. The bionic stress relief toy of claim 3, wherein, when the next splicing body rotates to the extreme position in the forward or rearward direction relative to the one splicing body, the peripheral edge of the one splicing body covers the front side edge of the main shell of the next splicing body on the radial outer side.

7. The bionic stress relief toy of claim 6, wherein, when the next splicing body rotates to the extreme position in the forward or rearward direction relative to the one splicing body, the peripheral edge of the next splicing body is hidden in the peripheral edge of the one splicing body on the radial inner side, or the peripheral edge of the next splicing body protrudes from the peripheral edge of the one splicing body on the radial inner side by a length less than or equal to 1.5 times a thickness of the peripheral edge of the one splicing body.

8. The bionic stress relief toy of claim 7, wherein outer diameters of the peripheral edges of the plurality of splicing bodies gradually increase and then gradually decrease in the front-rear direction.

9. The bionic stress relief toy of claim 8, wherein the plurality of splicing bodies further include a first splicing body, a last splicing body, and at least one middle splicing body, wherein a depth of the inner cavity of the at least one middle splicing body is larger than a depth of the inner cavity of the last splicing body and less than a depth of the inner cavity of the first splicing body.

10. The bionic stress relief toy of claim 7, wherein the plurality of splicing bodies further include a first splicing body, a last splicing body, and at least one middle splicing body, wherein a depth of the inner cavity of the at least one middle splicing body is larger than a depth of the inner cavity of the last splicing body and less than a depth of the inner cavity of the first splicing body.

11. The bionic stress relief toy of claim 6, wherein the plurality of splicing bodies further include a first splicing body, a last splicing body, and at least one middle splicing body, wherein a depth of the inner cavity of the at least one middle splicing body is larger than a depth of the inner cavity of the last splicing body and less than a depth of the inner cavity of the first splicing body.

12. The bionic stress relief toy of claim 3, wherein the plurality of splicing bodies further include a first splicing body, a last splicing body, and at least one middle splicing body, wherein a depth of the inner cavity of the at least one middle splicing body is larger than a depth of the inner cavity of the last splicing body and less than a depth of the inner cavity of the first splicing body.

13. The bionic stress relief toy of claim 2, wherein the plurality of splicing bodies further include a first splicing body, a last splicing body, and at least one middle splicing body, wherein a depth of the inner cavity of the at least one middle splicing body is larger than a depth of the inner cavity of the last splicing body and less than a depth of the inner cavity of the first splicing body.

14. The bionic stress relief toy of claim 1, wherein an extension is integrally formed between the female connector and the male connector.

15. The bionic stress relief toy of claim 14, wherein the plurality of splicing bodies further include a first splicing body, a last splicing body, and at least one middle splicing body, wherein a depth of the inner cavity of the at least one middle splicing body is larger than a depth of the inner cavity of the last splicing body and less than a depth of the inner cavity of the first splicing body.

16. The bionic stress relief toy of claim 1, further comprising a toy head and a toy tail, wherein a rear end of the toy head is provided with a head male connector corresponding to the female connector, and a front end of the toy tail is provided with a tail female connector corresponding to the male connector; the head male connector is rotatably connected to the female connector of a first splicing body, and the male connector of a last splicing body is rotatably connected to the tail female connector.

17. The bionic stress relief toy of claim 16, wherein the plurality of splicing bodies further include at least one middle splicing body, wherein a depth of the inner cavity of the at least one middle splicing body is larger than a depth of the inner cavity of the last splicing body and less than a depth of the inner cavity of the first splicing body.

18. The bionic stress relief toy of claim 16, wherein the toy head comprises a body part and a suspension part connected to a front end of the body part, and a rear end of the body part is connected to the head male connector; and the suspension part comprises at least two upper suspension arms and at least two lower suspension arms, and the upper suspension arms and the lower suspension arms are inclined outward and forward from a center of the body part.

19. The bionic stress relief toy of claim 18, wherein the toy head comprises an enclosing part and a connecting part connected to a rear end of the enclosing part, a rear end of the connecting part is connected to the head male connector, and the connecting part and the enclosing part are spaced apart to form a receiving space for receiving the front section of the peripheral edge of the first splicing body; and the toy tail comprises a tail cone segment and a transition cone segment which are connected to each other, a rear section of the peripheral edge of the last splicing body is located outside the transition cone segment, the tail female connector is connected to an inside of the tail cone segment, an outer diameter of the transition cone segment gradually increases in the front-rear direction, and an outer diameter of the tail cone segment gradually decreases in the front-rear direction.

20. The bionic stress relief toy of claim 16, wherein the toy head comprises an enclosing part and a connecting part connected to a rear end of the enclosing part, a rear end of the connecting part is connected to the head male connector, and the connecting part and the enclosing part are spaced apart to form a receiving space for receiving the front section of the peripheral edge of the first splicing body; and the toy tail comprises a tail cone segment and a transition cone segment which are connected to each other, a rear section of the peripheral edge of the last splicing body is located outside the transition cone segment, the tail female connector is connected to an inside of the tail cone segment, an outer diameter of the transition cone segment gradually increases in the front-rear direction, and an outer diameter of the tail cone segment gradually decreases in the front-rear direction.

21. The bionic stress relief toy of claim 1, wherein the female connector is a circular mating dimple, and the male connector is a spherical protrusion.

22. The bionic stress relief toy of claim 21, wherein the plurality of splicing bodies further include a first splicing body, a last splicing body, and at least one middle splicing body, wherein a depth of the inner cavity of the at least one middle splicing body is larger than a depth of the inner cavity of the last splicing body and less than a depth of the inner cavity of the first splicing body.

23. The bionic stress relief toy of claim 1, wherein the plurality of splicing bodies further include a first splicing body, a last splicing body, and at least one middle splicing body, wherein a depth of the inner cavity of the at least one middle splicing body is larger than a depth of the inner cavity of the last splicing body and less than a depth of the inner cavity of the first splicing body.

* * * * *